US010607579B1

(12) United States Patent
Louscher

(10) Patent No.: US 10,607,579 B1
(45) Date of Patent: Mar. 31, 2020

(54) ADJUSTABLE MUSICAL INSTRUMENT BODY

(71) Applicant: Anthony W. Louscher, Green Bay, WI (US)

(72) Inventor: Anthony W. Louscher, Green Bay, WI (US)

( * ) Notice: Subject to any disclaimer, the term of this patent is extended or adjusted under 35 U.S.C. 154(b) by 0 days.

(21) Appl. No.: 16/408,629

(22) Filed: May 10, 2019

(51) Int. Cl.
*G10D 1/08* (2006.01)

(52) U.S. Cl.
CPC ..... *G10D 1/085* (2013.01)

(58) Field of Classification Search
CPC ..... G10D 1/085
See application file for complete search history.

(56) References Cited

U.S. PATENT DOCUMENTS 2,529,693 A * 11/1950 Hal Horne ..... A63H 5/00 446/416
4,232,582 A * 11/1980 Diamond ..... G10D 1/08 181/131
4,428,268 A * 1/1984 Ingoglia ..... G10D 1/085 181/131
5,682,003 A * 10/1997 Jarowsky ..... G10D 1/085 84/267
6,069,307 A * 5/2000 Rogers ..... G10D 13/023 84/411 R
8,479,879 B2 * 7/2013 Hawwa ..... F04B 39/0061 181/212
2006/0137932 A1 * 6/2006 Hatch ..... G10D 1/085 181/131
2018/0286362 A1 * 10/2018 Barnes ..... G10D 17/00

* cited by examiner

*Primary Examiner* — Robert W Horn
(74) *Attorney, Agent, or Firm* — Anthony W. Louscher

(57) ABSTRACT

A stringed musical instrument with a body having at least one hollow space within including one or more vents allowing movement of air into and out of the instrument body. The back includes a back access panel attached to the back allowing access into the body. A threaded fastener extending between the back access panel and a top of the instrument body. The fastener is accessible and movable from outside the instrument body. The back access panel is flexible so that turning in the threaded fastener will deflect the back panel and alter the instrument body.

8 Claims, 14 Drawing Sheets

PRIOR ART

PRIOR ART

PRIOR ART

PRIOR ART

ADJUSTABLE MUSICAL INSTRUMENT BODY

PRIORITY CLAIM

The present application claims priority to U.S. Provisional Application Ser. No. 62/777,620, filed on Dec. 10, 2019, the disclosure of which is incorporated herein in its entirety by reference.

BACKGROUND

This disclosure pertains generally to the field of a variety of musical instruments, and more specifically, yet not limited to, an electric guitar, to alter audio feedback frequencies, and enhance desirable acoustic overtones and sustain when played at high levels of electric amplification.

Historically electrically amplified musical instruments, such as acoustic and semi-hollow body guitars, have been difficult to amplify dependably at a high level of volume. When musical instruments are electrically amplified at high levels of volume, they often produce undesirable audio feedback frequencies; such as high-pitched squealing and squelching. Playing such electrically amplifying guitars, in smaller venues and at lower levels of amplification, will not always produce these undesirable aspects of audio feedback. However, while performing in large concert halls, auditoriums and areas, there is typically the need to electrically amplify guitars at a much higher volume. The essential problem is controlling those undesirable high-pitched squealing and squelching aspects of audio feedback while electrically amplifying the instrument at greater volumes.

Audio feedback, also known as acoustic feedback (or the Larsen effect) is a special kind of positive loop gain which occurs when a sound loop exists between an audio input (for example, a microphone or guitar pickup) and an audio output (for example, a power amplified loudspeaker). In this example, a signal received by the guitar is amplified and passed out of the loudspeaker. The sound-wave from the loudspeaker can then be received by the guitar again, amplified further, and then passed out through the loudspeaker again. This reaction from guitar—to amplifier—to speaker repeats itself and is incrementally augmented. The frequency of the resulting sound is determined by: resonance frequencies in the guitar, amplifier, loudspeaker, the acoustics of the room, the directional pick-up and emission patterns of the guitar and loudspeaker, and the distance between them. In physics, resonance is the tendency of a system to vibrate with increasing amplitudes at some frequencies of excitation. These are known as the system's resonant frequencies (or resonance frequencies). The resonator may have a fundamental frequency and any number of harmonics.

The device and method of the present disclosure may mechanically alter much of the undesirable audio feedback frequencies while enhancing the desirable characteristics, such as resonance, the sustaining of notes and chords, overtones and harmonic overtones frequencies.

In the past several decades there have been many attempts by other inventors to control or diminish the aforementioned undesirable audio feedback frequencies; as well as to replicate the more desirable characteristic audio feedback frequencies. However, other inventors have approached this issue by using software, digital produced sound (DPS), and electronic methods to achieve a desired result. Utilizing software, DPS, and electronic methods to rectify these issues have created products that can sound homogenized or suppressed; not producing the true or natural sustain, resonance, overtones and harmonic overtones.

One of these inventions is called a Sustainer Pick Up. The Sustainer Pick Up is an electro-magnetic guitar pick up that artificially produces sustain for notes and chords at many levels of amplification. This product does achieve some desired results yet lacks the genuine overtones and harmonic overtone frequencies that occur naturally.

A similar parallel would point to the arguments about the quality of Hi-Fidelity musical recordings produced on "vinyl"—verses the advent of digital sound production. There is good evidence that digitally produced recordings, using "Dolby NR", have less clarity and less sound spectrum that do not capturing the complete sound band, due to the sound frequencies being digitally compressed in the transfer to CD or DVD discs. Though many benefits of Dolby NR are notable, the down side of its use in recording was the loss of fidelity. Over the past few decades, scores of young and aging consumers have rediscovered the benefits of the original Hi-Fidelity analog recordings of music; and the market for "vinyl" is back.

BRIEF DESCRIPTION OF THE DRAWINGS

The accompanying drawing figures, which are incorporated in and constitute a part of the description, illustrate several aspects of the present disclosure and together with the description, serve to explain the principles of the present disclosure. A brief description of the figures is as follows.

DETAILED DESCRIPTION

Figure 1:
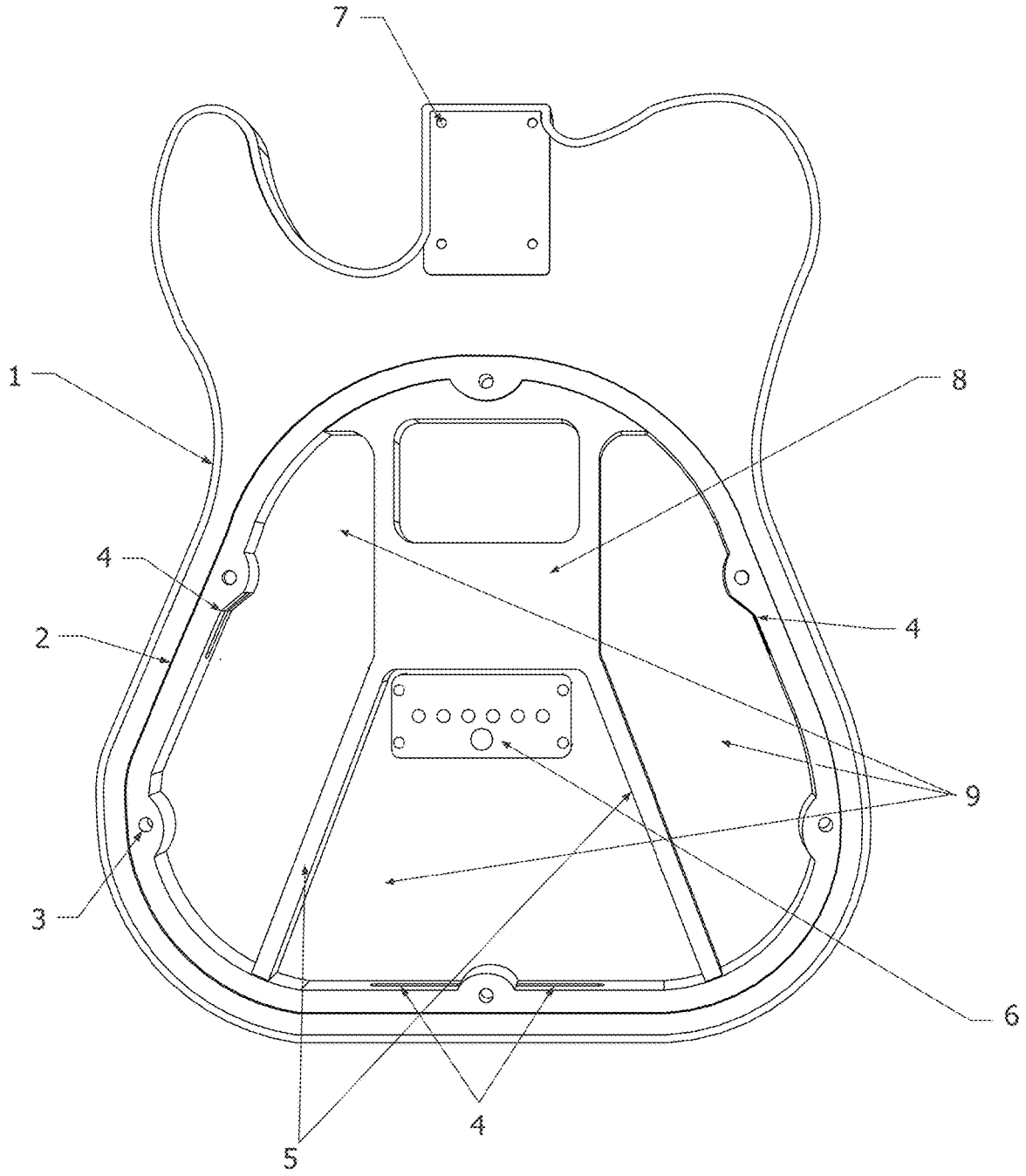
FIG. 1 is a rear view of an electric guitar body according to the present disclosure, with a back access panel removed.
Figure 1A:
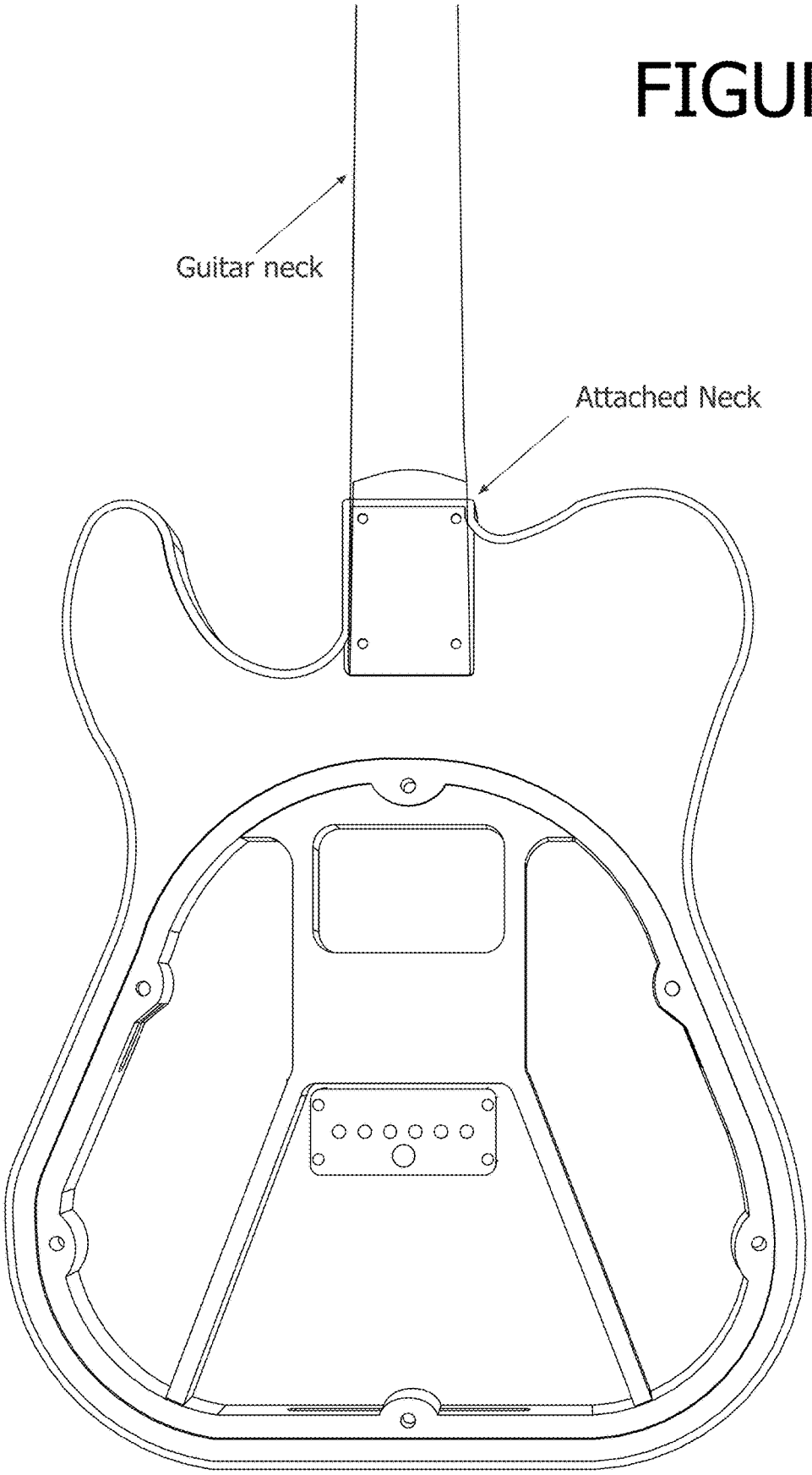
FIG. 1A is a rear view of the electric guitar body of FIG. 1, with a guitar neck attached.
Figure 2:
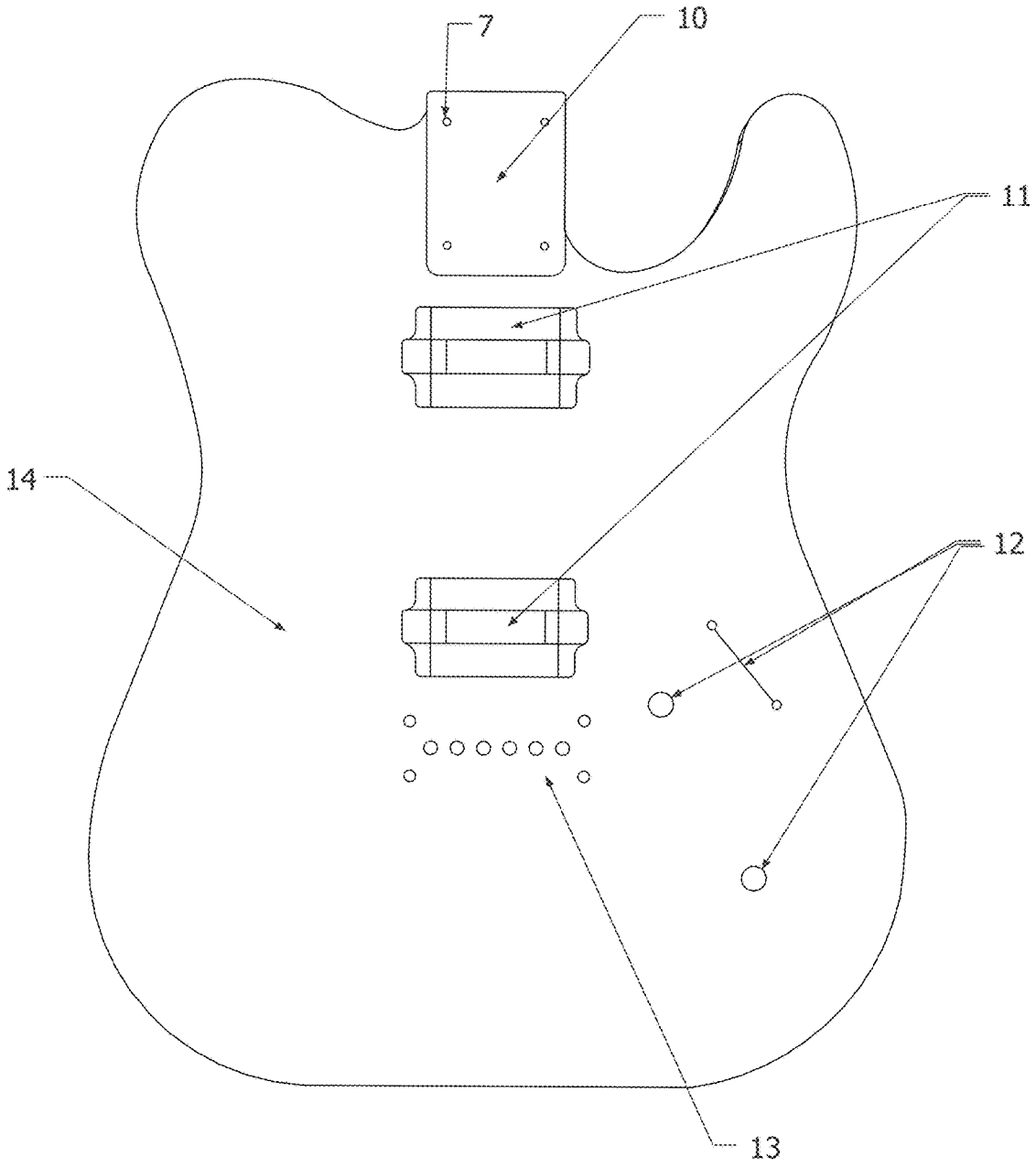
FIG. 2 is a front view of the electric guitar body of FIG. 1.
Figure 2A:
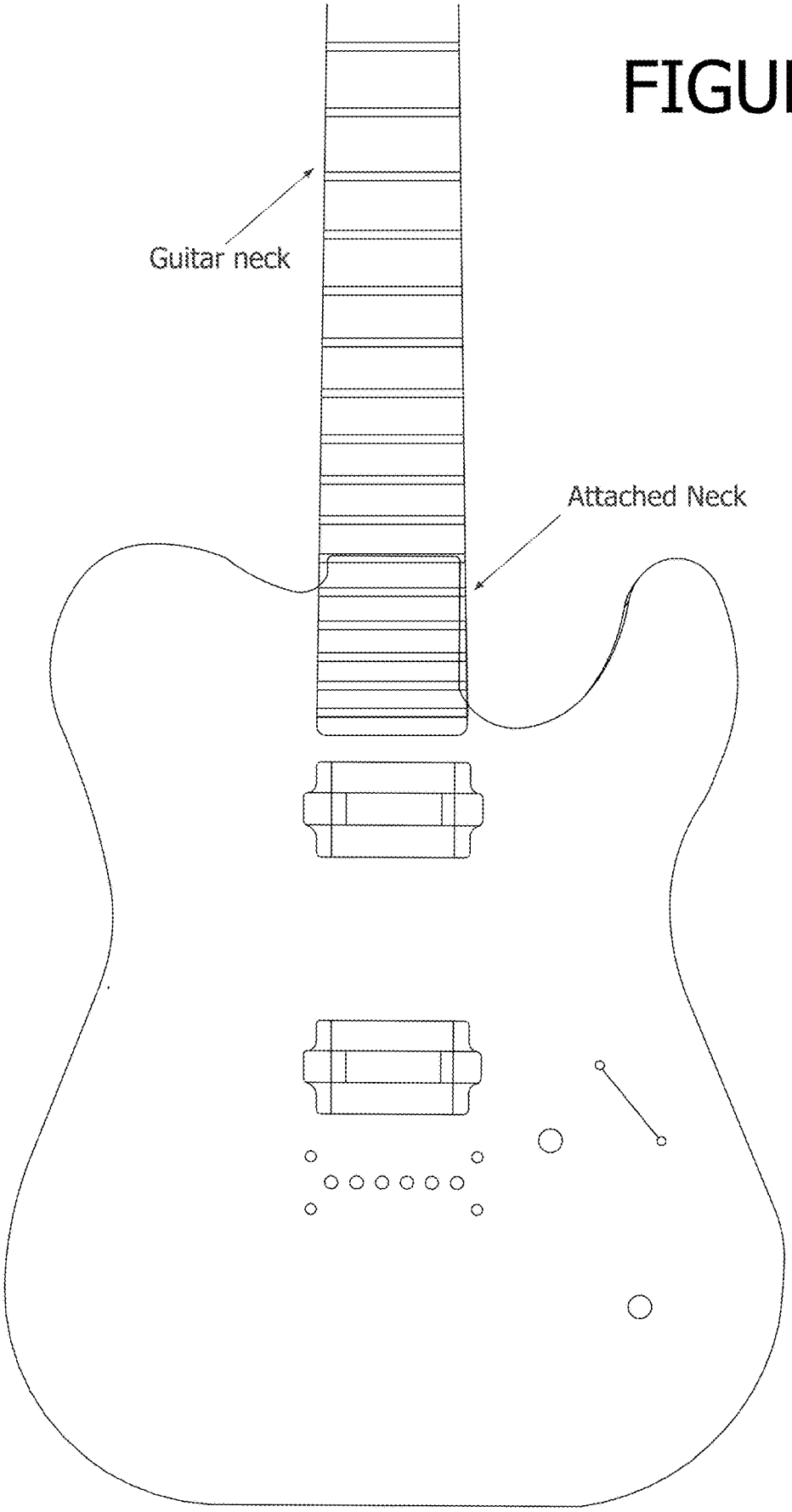
FIG. 2A is a front view of the electric guitar body and neck of FIG. 1A.
Figure 3:
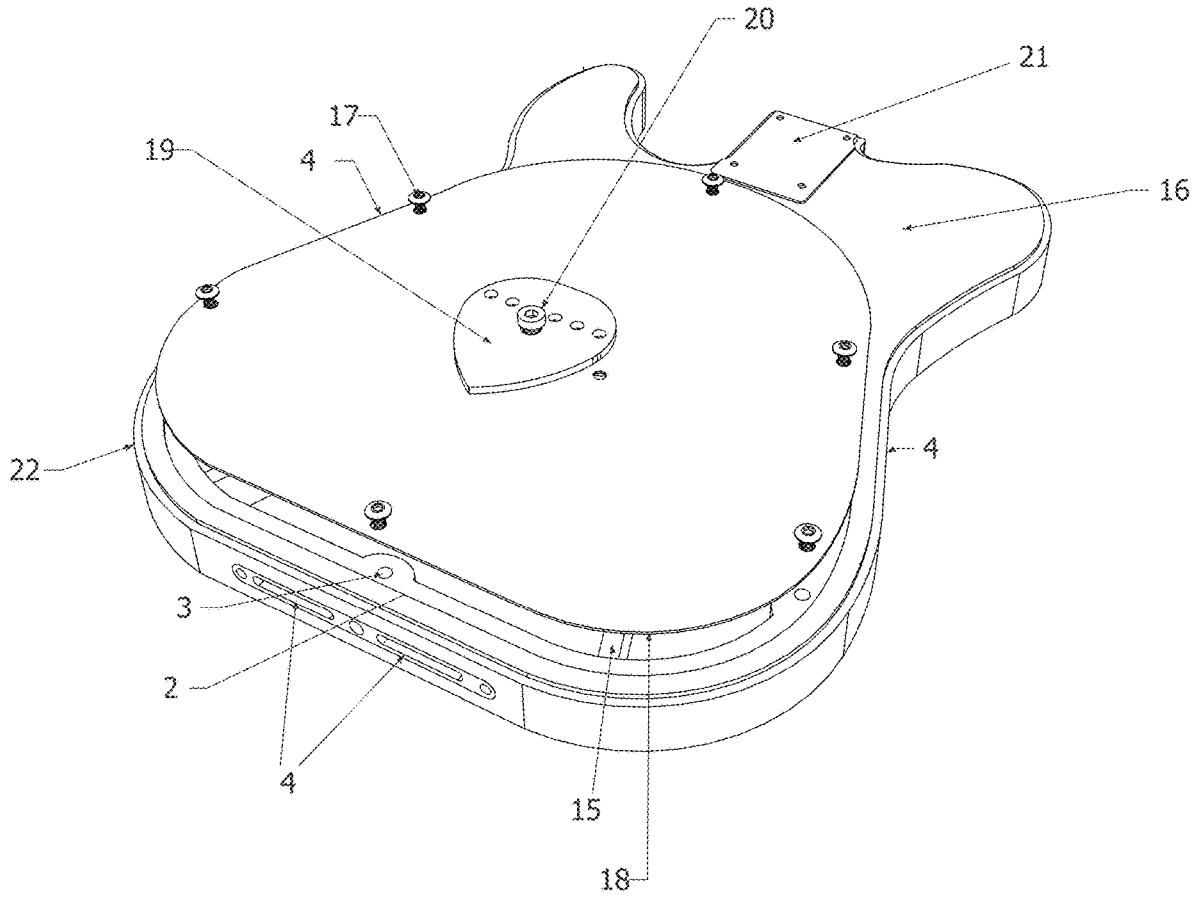
FIG. 3 is a rear perspective exploded view of the electric guitar body of FIG. 1 showing a removable back access panel.

Reference will now be made in detail to exemplary aspects of the present disclosure which are illustrated in the accompanying drawings. Wherever possible, the same reference numbers will be used throughout the drawings to refer to the same or like parts.

The musical instrument of the present disclosure may be manufactured in the form of an electrically amplified, semi-hollow chambered guitar body, having a removable back-access panel and a unique guitar bridge assembly to address an age-old problem of undesirable audio feedback and presenting unexpected benefits.

The improved musical instrument design of the present disclosure may be implemented with a purely mechanical method to change the physics of the instrument—by applying tension to a flexible panel on the back of the guitar by way of, but not limited to, turning-in a tensioning bolt of the bridge assembly.

It is our understanding that compressing the back-access panel of the disclosed musical instrument—tensioning the panel and/or bending it inward—may cause the top of the guitar to become more rigid and possibly become more resistant to the feedback loop and unwanted frequencies. Also, compressing the back-access panel may alter the measurable air-mass inside the guitar, causing an alteration in harmonic overtones and feedback frequencies which may be especially noticeable at high levels of electric amplification.

Referring now to FIGS. 1-7A, according to the present disclosure: a chambered semi-hollow guitar body, herein referenced as guitar body 1, where much of the wood mass has been routed out, or, removed from a back portion of the guitar body 1 to create a plurality of chambered spaces 9. The chambered spaces 9 in the back of the guitar body 1 may include structural braces 5. The structural braces 5 may add strength to a top 14 of the guitar body 1 and may improve resistance to audio feedback. When electrically amplified, the chambered spaces 9 of guitar body 1 may produce unique, tone, harmonic frequencies and resonance. The chambered spaces 9 provide space for a bridge middle part 6. The chambered spaces 9 may provide space for the necessary electronic components as well. The guitar body 1 may also include acoustic vents or air ports 4. These air ports 4 may be routed or machined onto the side walls of the guitar body 1 which allow an inner air mass within guitar body 1 to move or escape when the guitar is played when electrically amplified.

A flexible back-access panel 18 may be placed over the back of the guitar body 1 to cover the routed open space. The back-access panel 18 may be removably affixed to a recessed ledge surface 2 of the guitar body 1 by screws 17. The screws 17 may use threaded fasteners 3 to secure the perimeter of the back-access panel 18 firmly but releasably to the ledge surface 2. The back-access panel 18 will preferably remain stiff yet flexible at the center.

It is anticipated that the back-access panel 18 be preferably made of materials such as polycarbonate, aluminum, carbon fiber, ABS, wood, or similar materials, that can be crafted to provide a desired level of flexibility and/or stiffness and may create a desired frequency response. Other materials may be used to make the back-access panel 18 within the scope of the present disclosure which will allow for the selection of various characteristics and it is not intended to limit the selection of materials in this application.

Figure 4:
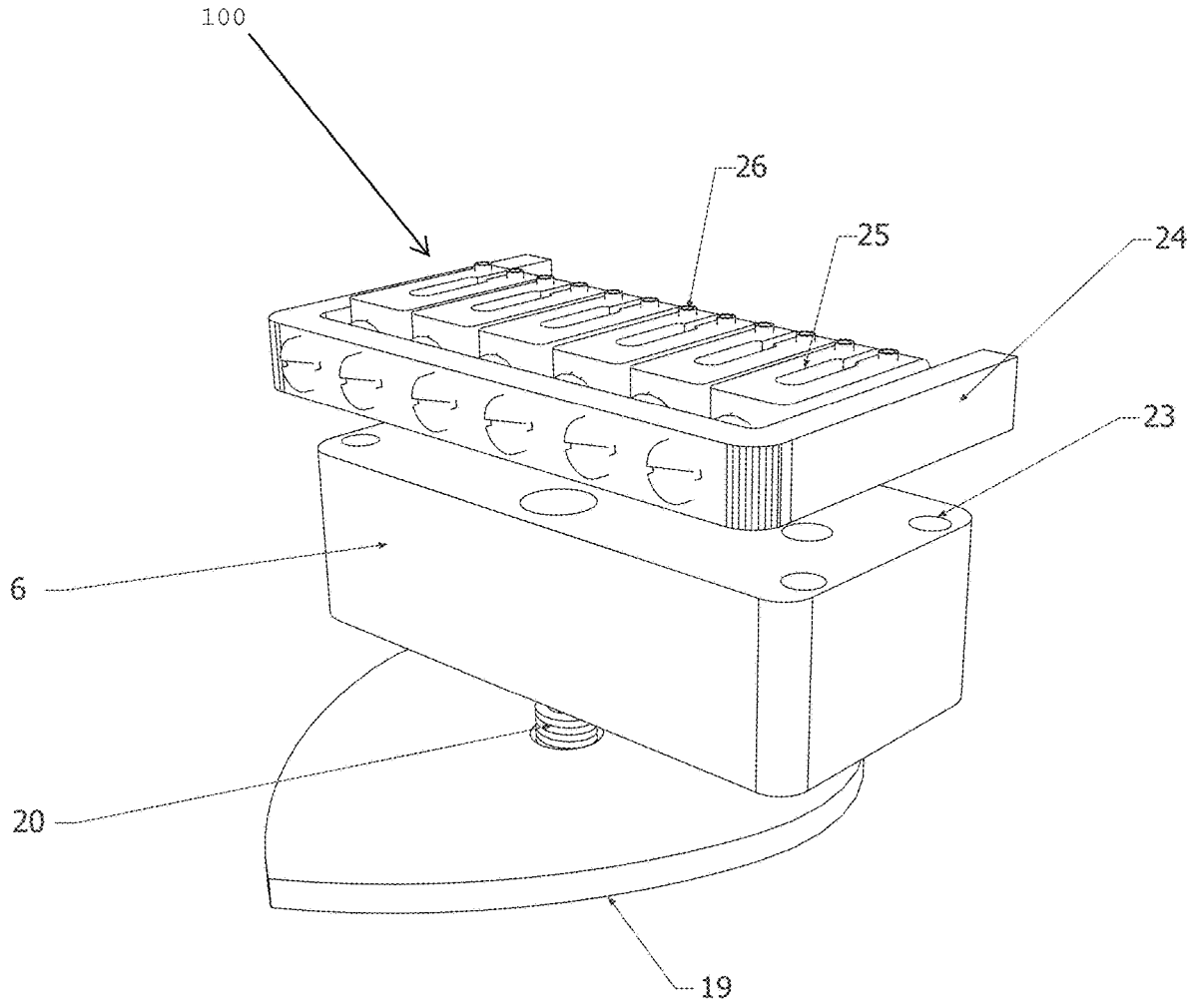
FIG. 4 is a perspective of a bridge assembly of the electric guitar body of FIG. 3.
Figure 5:
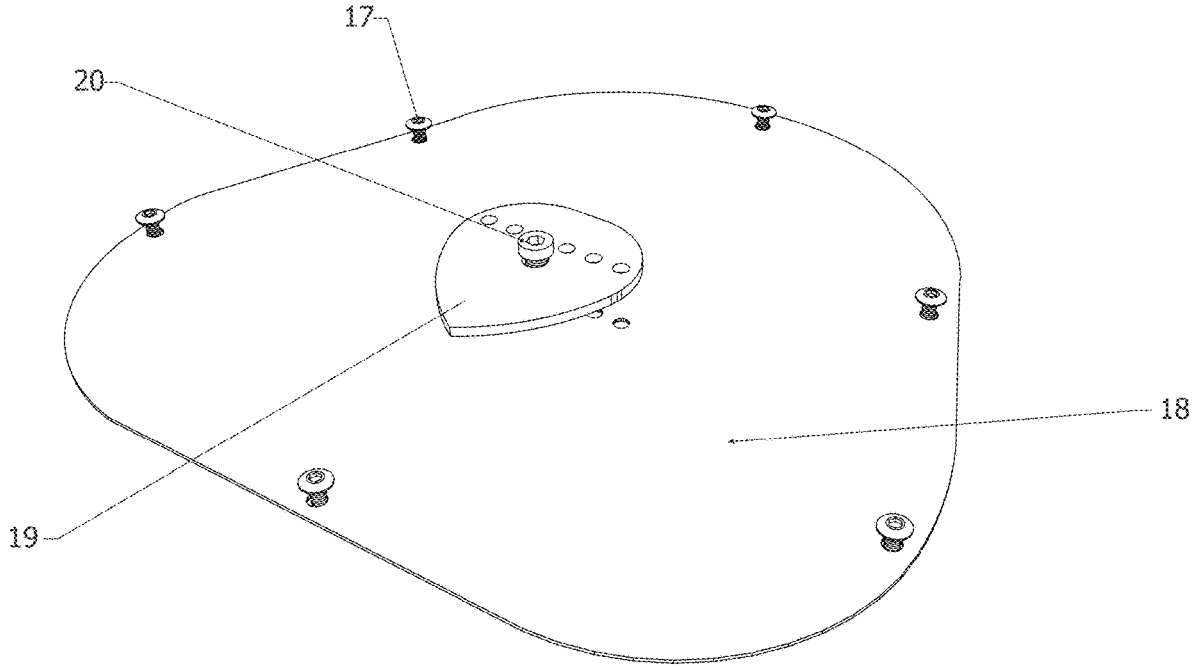
FIG. 5 is a perspective view of the removable back access panel, select bridge parts and screws of FIG. 3.
Figure 6:
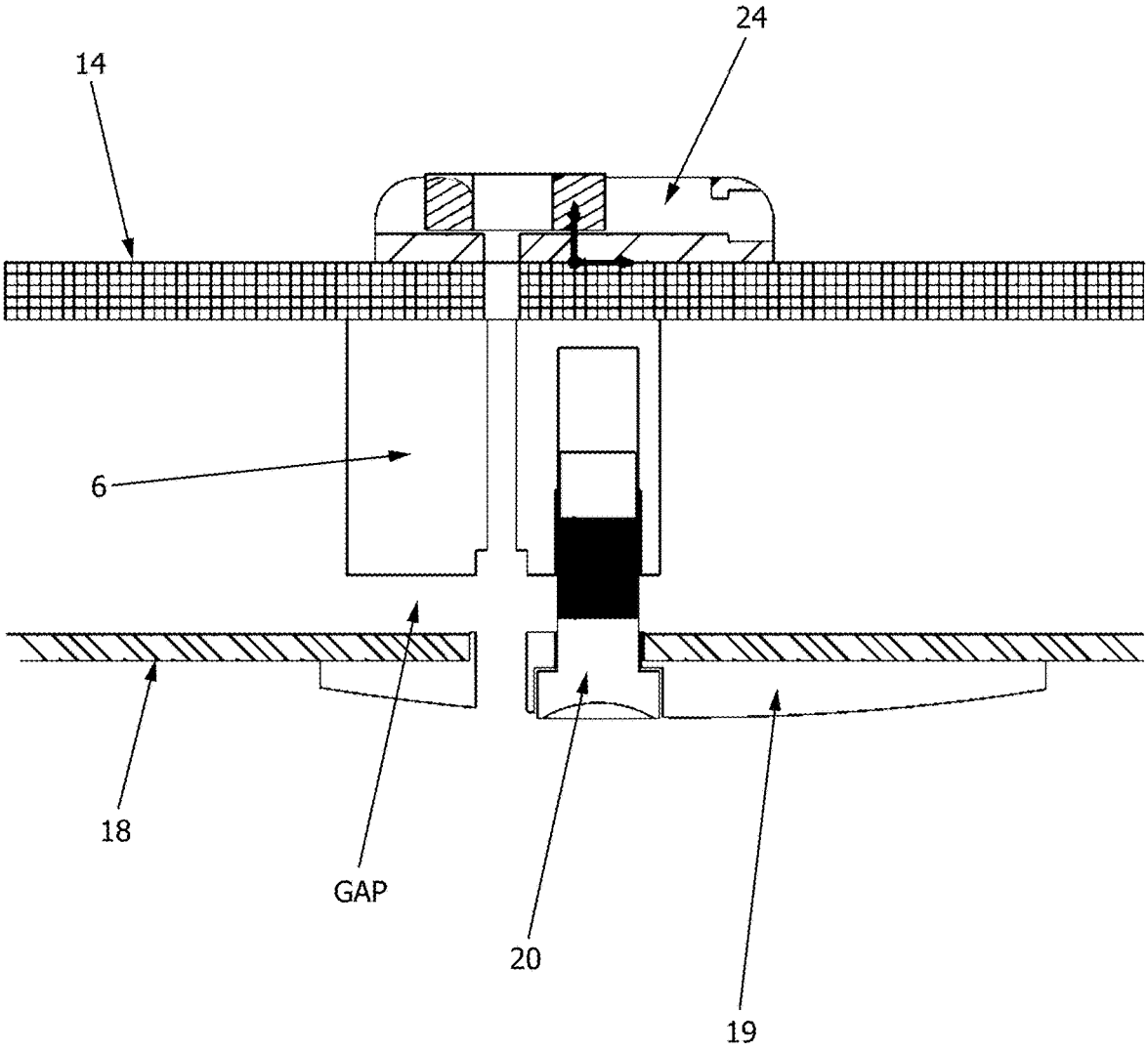
FIG. 6 is a longitudinal cross-section view of the electric guitar body and bridge assembly of FIG. 3.
Figure 7:
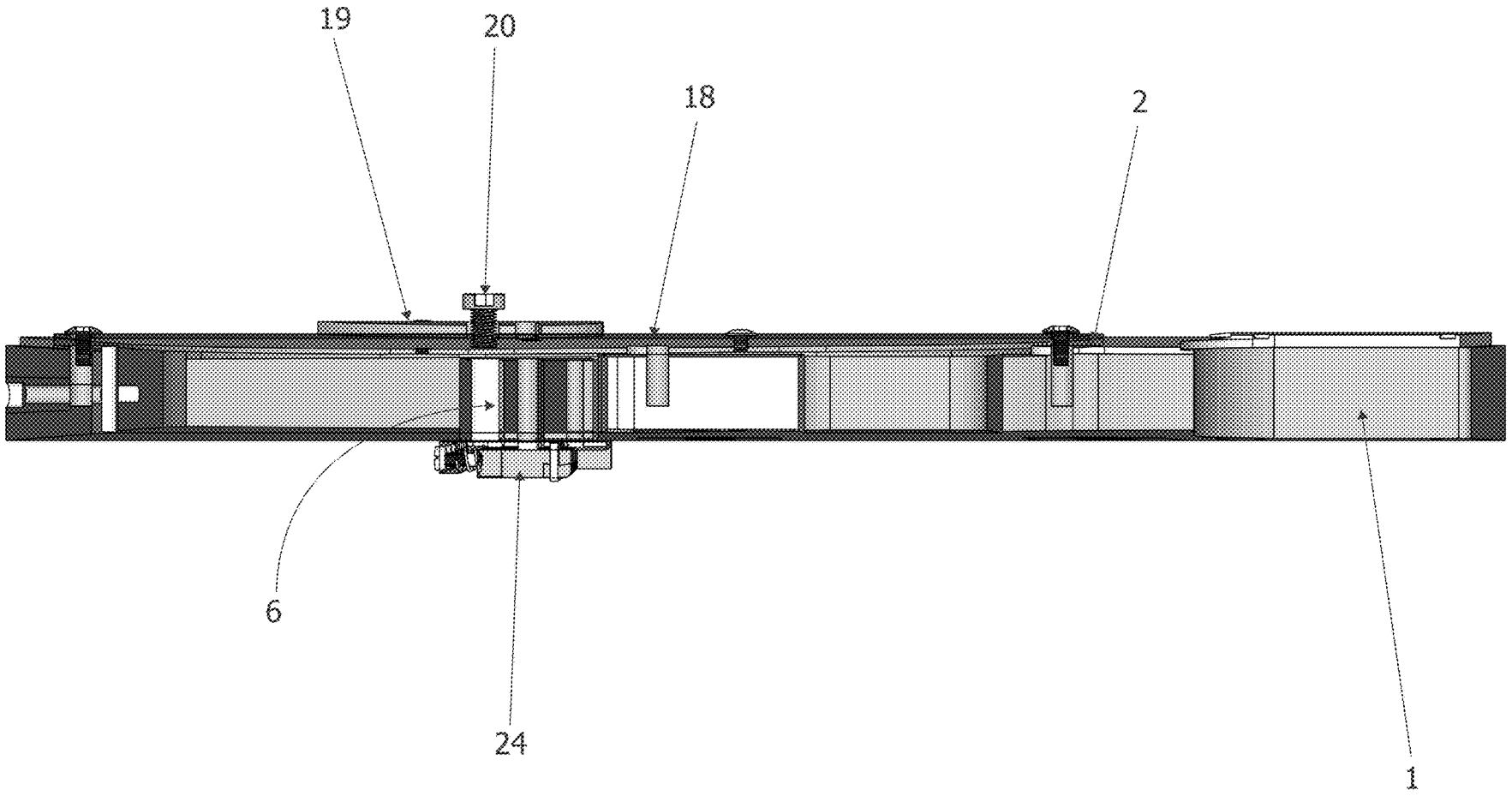
FIG. 7 is a larger cross section view of the electric guitar body and bridge assembly of FIG. 3.
Figure 7A:
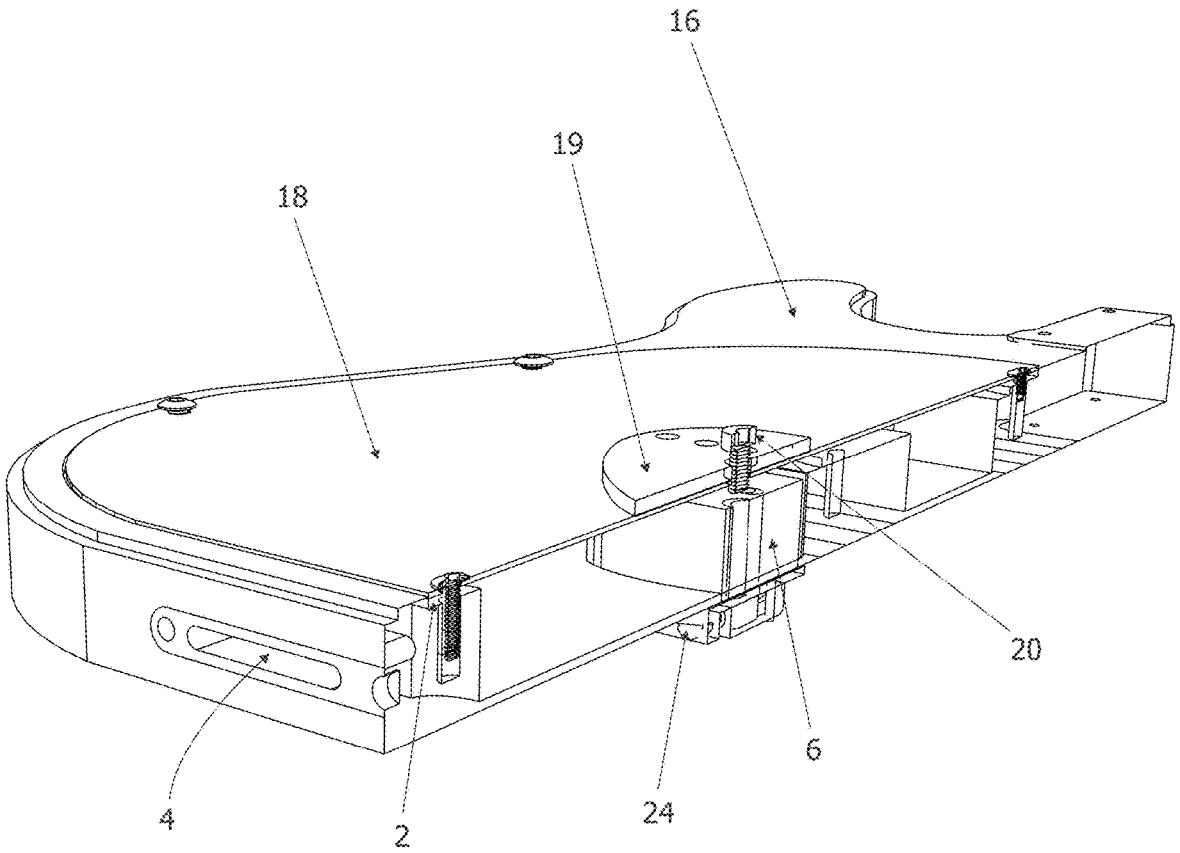
FIG. 7A is a perspective cut-away view of the electric guitar body and bridge assembly of FIG. 3.

Referring now to FIG. 4, a bridge assembly 100 is isolated from other elements of the present disclosure, may be made of various parts which include yet not be limited to: a top part 24, adjustable saddle pieces 25, height-adjustment screws 26, a tensioning bolt 20, middle part 6 and a bridge back plate 19. All parts may be integral elements of the present disclosure.

Referring again to the drawings according to the present disclosure: when the various bridge parts, presented in FIG. 4, are installed according to the present disclosure, and, with the back-access panel 18 attached to the ledge surface 2 of the guitar body 1, the back-access panel 18 can be tightened inward with the aid of the tensioning bolt 20 that connects with the back plate 19 of the bridge assembly. Turning the tensioning bolt 20, clockwise or counter clockwise, may increase or decrease the tension to the back-access panel 18, which will preferably change the shape of the back-access panel 18. Specifically, how much the back-access panel 18 bows inward or outward in relation to the bridge middle part 6 may be determined by the force applied by the tensioning bolt 20.

As tension is increased or decreased to the back-access panel 18, by way of the tensioning bolt 20, two or more critical events may be occurring to the guitar body 1. First, applying tension to the tensioning bolt 20, may add stress to the back-access panel 18, that may create a pulling action on the middle part 6, which in turn may create added stiffness to the top 14 of the guitar body 1. The more turns applied to the tensioning bolt 20, the more rigid or stiff the top 14 of the body 1 may become. As the top 14 of the body 1 develops more rigidity it may vibrate less and become more resistant to audio feedback at high levels of electric amplification. Second, flexing the back-access panel 18, with increased or decreased tension by tensioning bolt 20 may cause the air mass inside the guitar body 1 to be changed. This change in air mass may then cause an alteration in harmonic overtones and audio feedback frequencies of the guitar and may affect sound produced at high levels of electric amplification.

We anticipate that the air mass inside the chambered spaces 9 of the present device may contain a measurable static frequency. We also anticipate that the air mass and the measurable static frequency inside the chambered spaces 9 of the present device may be altered by flexing the back-access panel 18 with increased or decreased turns to tensioning bolt 20.

Referring now to the drawings according to the present disclosure: within the guitar body 1, the aforementioned structural braces 5 and the chambered spaces 9 may be redesigned in future devices and methods and would simply be alterations of the present disclosure. These future changes may result in altering the placement, size, and or the shapes of the said structural braces 5 and chambered spaces 9; in the anticipation of producing new and diverse modulations.

Referring now to the drawings according to the present disclosure, it is anticipated that the back-access panel 18 may be altered within the scope of the present disclosure. It is possible that future designs, devices and methods could be applied, such as but not limited to: altering the size and shape of back-access panel 18, introduction of new materials, several holes or perforations may be added in the anticipation of producing diverse modulations.

Reference will now be made to PRIOR ART musical instruments illustrated in FIGS. 8 to 10.

Figure 8:
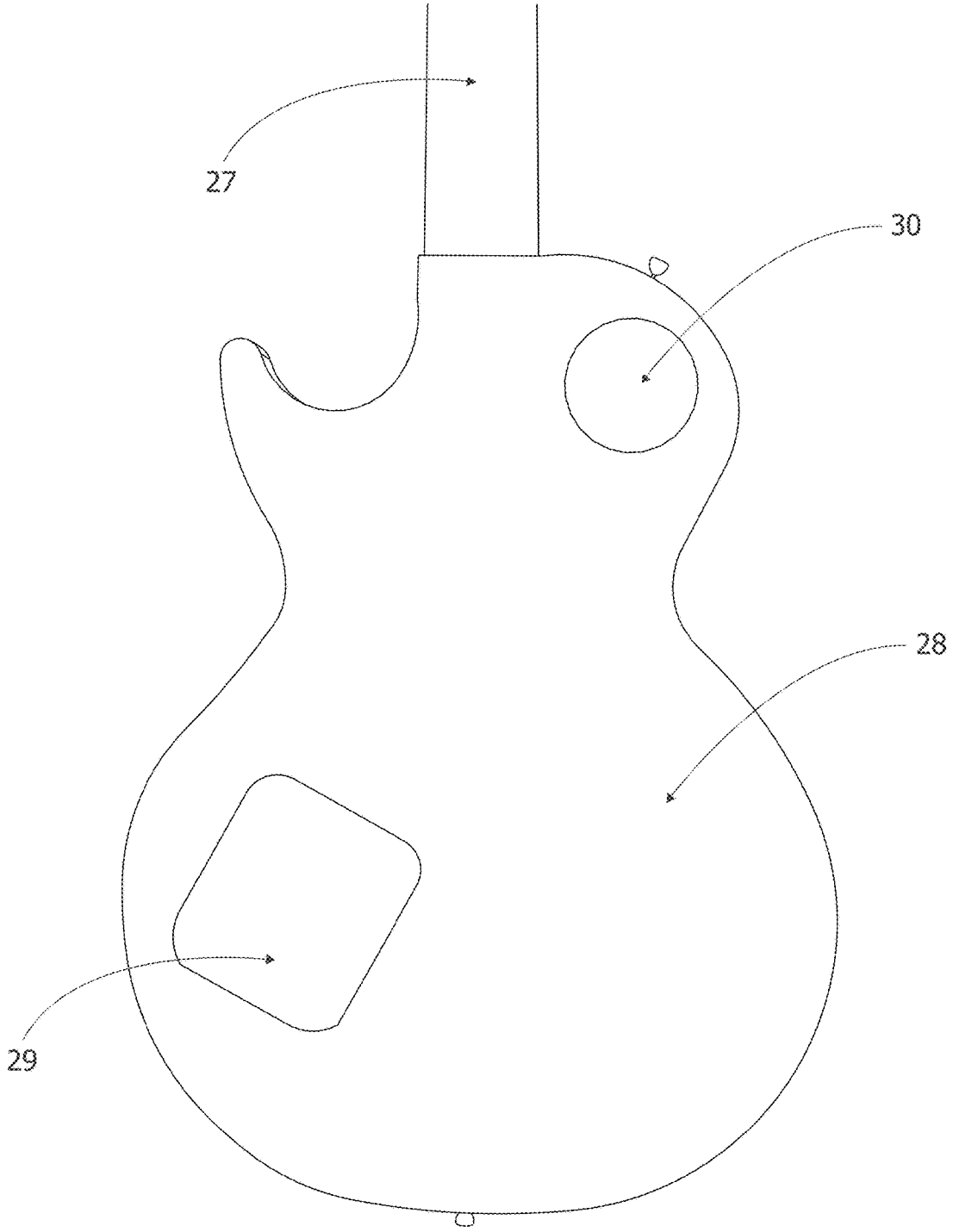
FIG. 8 is a rear view of PRIOR ART electric guitar that shows typical electronic component cavities with access panels installed over the cavities.
Figure 8A:
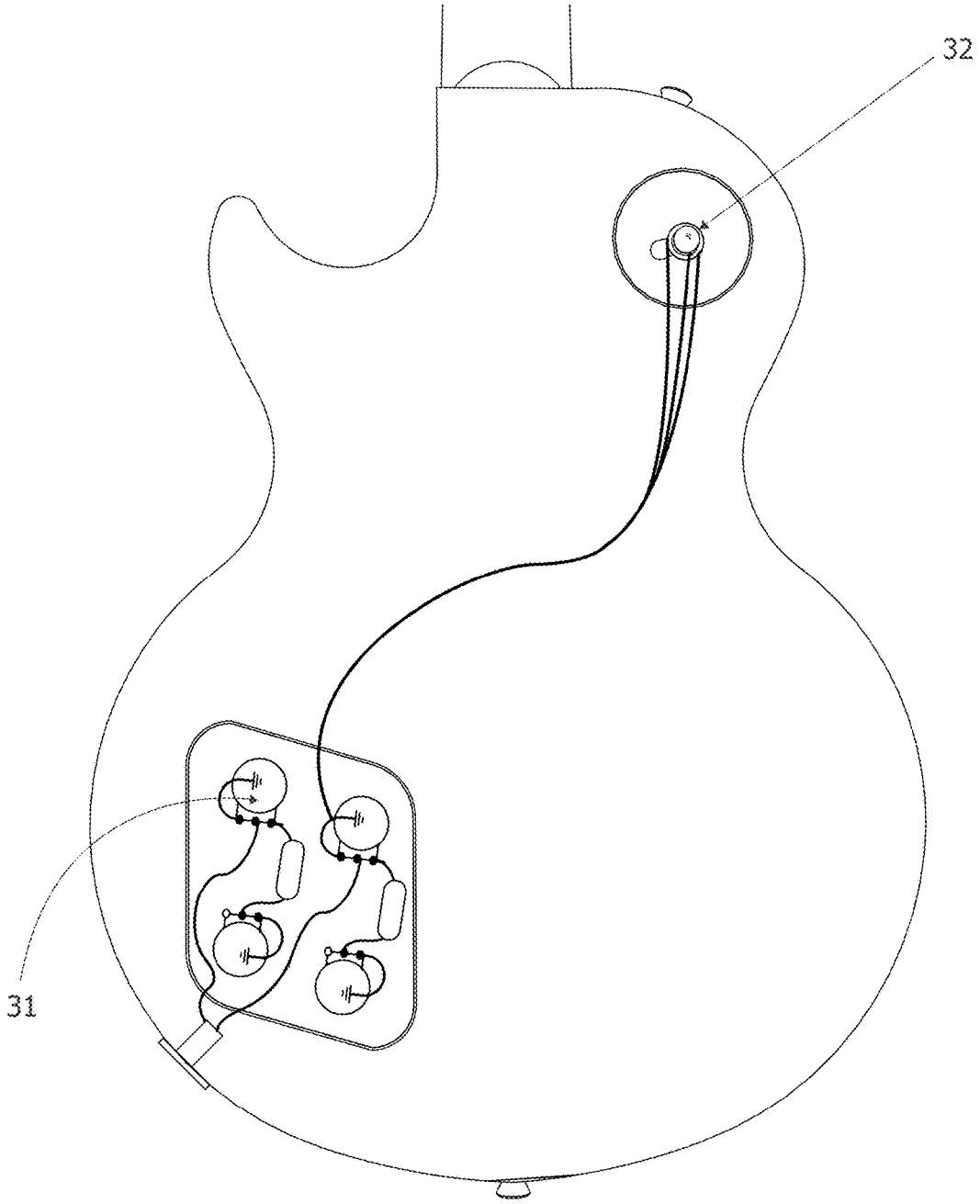
FIG. 8A is a rear view of PRIOR ART electric guitar of FIG. 8 showing typical electronic component access cavities with access panels removed and electronic components displayed for reference.

FIGS. 8 and 8A illustrate a neck 27 and an instrument body 28 of a popular PRIOR ART guitar design. Instrument body 28 includes a back-access panel 29 and a back access panel 30 covering cavities within the instrument body where select electronic components 31 and 32, respectively, would be installed. As contrasted with the musical instrument of the present disclosure, back access panels 29 and 30 and the cavities they cover are considerably smaller. No provision is made in the PRIOR ART guitar bodies to provide to alteration in the tension of the back access panels to accomplish any of the advantages presented by the present disclosure.

Figure 9:
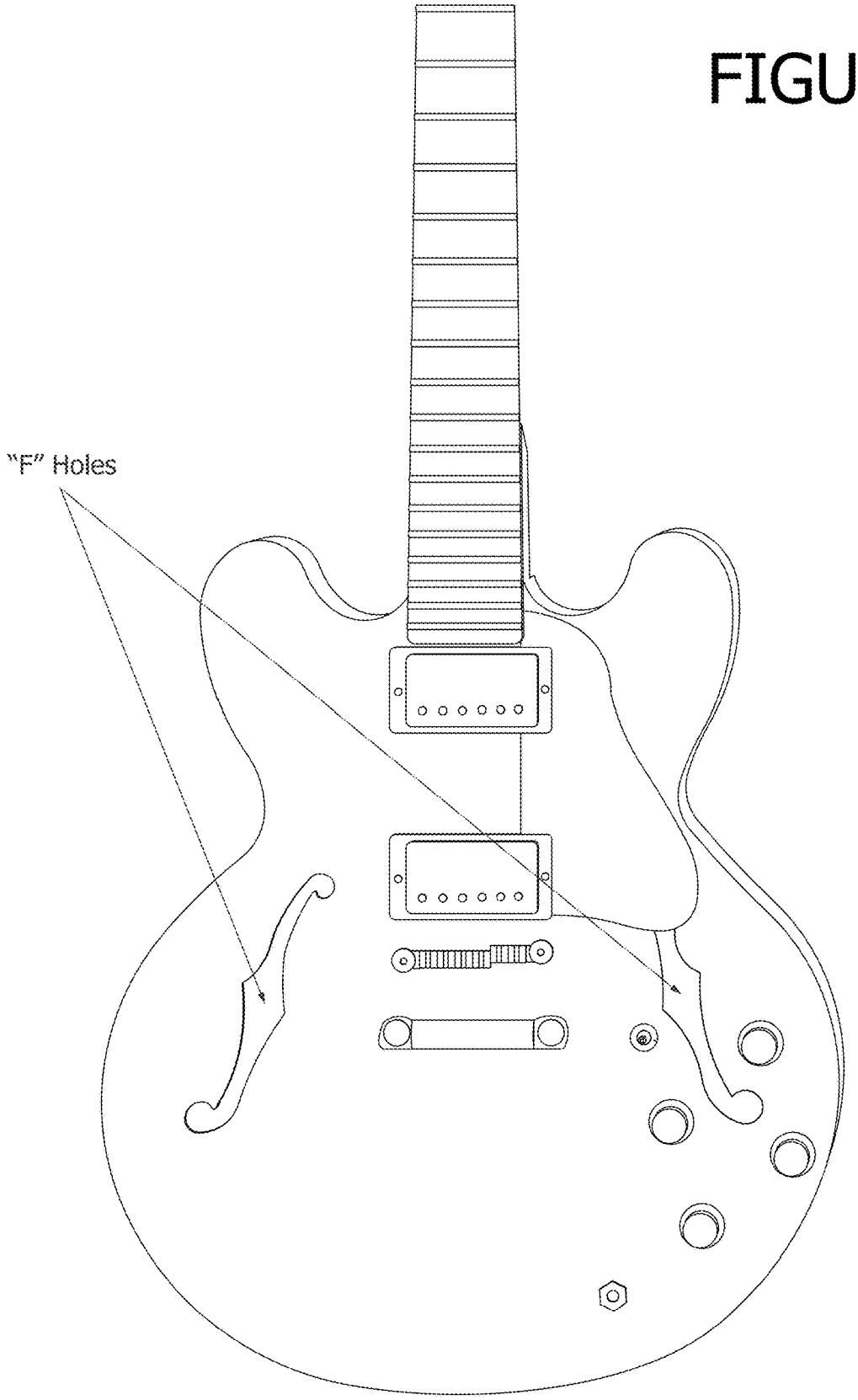
FIG. 9 is a front view of a PRIOR ART semi-hollow body electric guitar that displays "F' holes that represent the typical access cavities used to install and remove electronic components.

FIG. 9 illustrates a PRIOR ART popular semi-hollow body guitar that shows the "F" Holes on the top of the guitar. The "F" Holes, that are routed in to the top of this guitar, are often the only access areas to install or repair electronic components. Also, the "F" Holes on the top of this traditional semi-hollow body guitar—are the actual ports that are used to vent-out the air mass within this guitar body; when the guitar is electronically amplified. The inclusion of such "F" Holes in PRIOR ART musical instruments to allow access to components within instrument bodies removes the need to the inclusion of any rear openings or back access panels.

Figure 10:
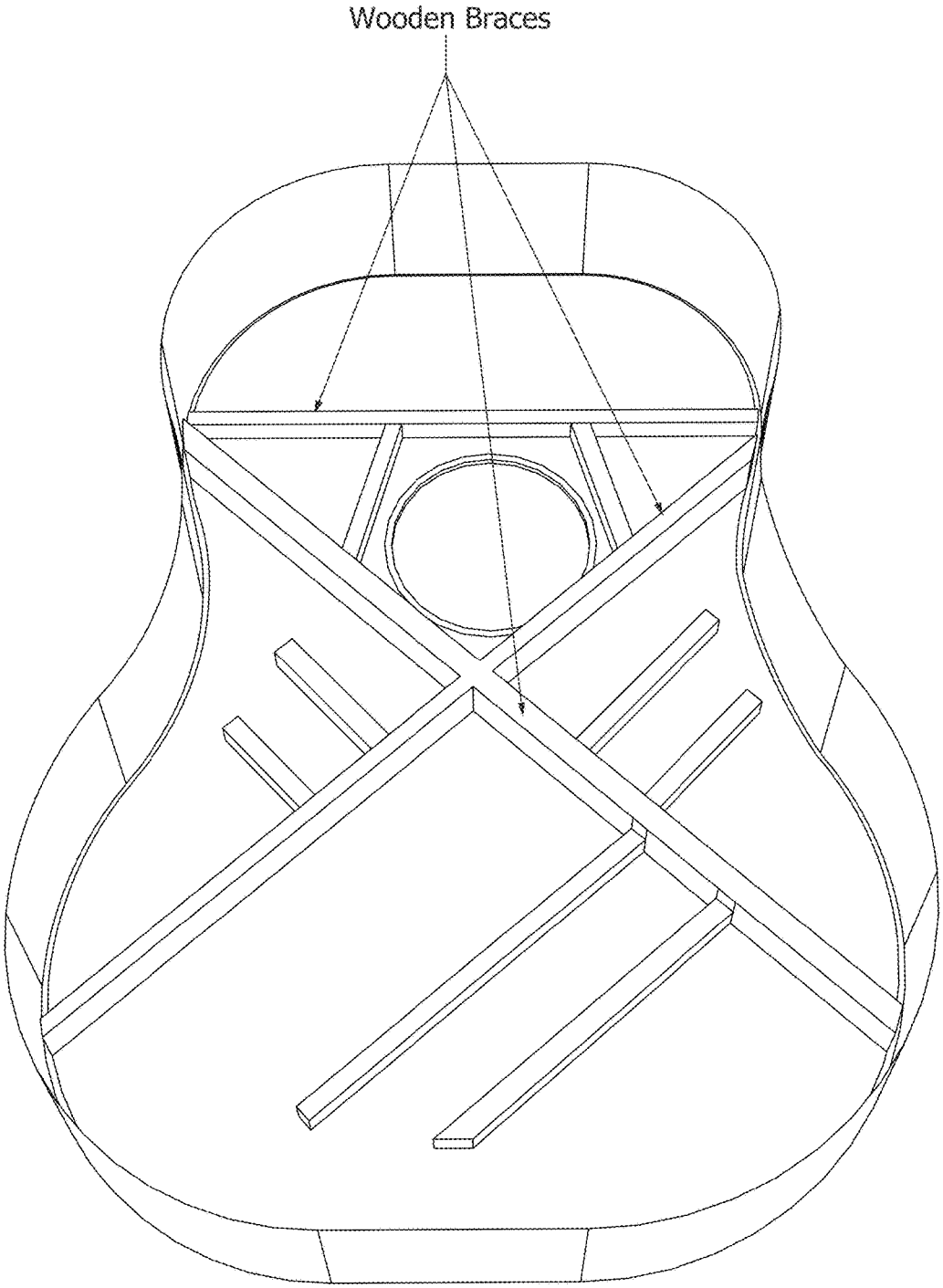
FIG. 10 is a rear perspective view of a PRIOR ART acoustic guitar design with a rear cover omitted to show a bracing pattern on a top of the guitar.

FIG. 10 illustrates an inside view of a PRIOR ART acoustic guitar design. This drawing displays a popular wood bracing pattern, indicated in the image as "Wooden Bracing", that adds rigidity to the top of a guitar as well as providing enhanced volume. The choice for such bracing design has traditionally been driven by a need to support bridges or string attachment points.

While the present disclosure has described various preferred embodiments, it is to be understood that the present disclosure is not intended to be limited to the specific embodiments set forth above. Thus, it is recognized that those skilled in the art will appreciate that certain substitutions, alterations, modifications, and omissions may be made without departing from the spirit or intent of the present disclosure. Accordingly, the foregoing description is meant to be exemplary only, the present disclosure is to be taken as including all reasonable equivalents to the subject matter of the present disclosure and should not limit the scope of the present disclosure set forth in the following claims.

What is claimed is:

1. A stringed musical instrument comprising:

an instrument body having a top, a back and at least one hollow chambered space within, the hollow chambered spaces including one or more vents allowing movement of air into and out of the instrument body;

the back including a back access panel which is removably attached to the back and which allows access into the hollow chambered spaces of the instrument body;

a threaded fastener extending between the back access panel and the top of the instrument body within one of the hollow chambered spaces, the threaded fastener accessible and movable from outside the instrument body when the back access panel is attached to the instrument body;

the back access panel being flexible so that turning in of the threaded fastener will deflect the back panel and reduce the air mass within the instrument body.

2. The stringed musical instrument of claim 1, wherein the musical instrument is electrically amplified with pickups mounted to the stringed musical instrument and one or more electrical components mounted within the instrument body and accessible with the back access panel removed.

3. The stringed musical instrument of claim 1, wherein the amount of deflection of the back access panel may be selected to modify the musical characteristics of the stringed musical instrument.

4. The stringed musical instrument of claim 1, wherein turning in the threaded fastener also increases the tension applied to the top of the stringed musical instrument and the tension applied to the top of the stringed musical instrument may be selected to alter feedback characteristics of the stringed musical instrument.

5. The stringed musical instrument of claim 1, further comprising the top of the instrument body including a bridge assembly, the bridge assembly including a top part at least partially outside the top, a middle part between the top and the back access panel, a bridge back plate at least partially outside the back access panel and the threaded fastener extending between the bridge back plate and the middle part.

6. The stringed musical instrument of claim 1, further comprising the back access panel engaging a recessed ledge on the back of the stringed musical instrument and releasably attached with removable fasteners.

7. The stringed musical instrument of claim 2, wherein the stringed musical instrument is an electric guitar and increasing tension applied to the back access panel and top of the guitar by the threaded fastener alters the harmonic characteristics and the audio feedback characteristics of the guitar, particularly at high levels of electric amplification.

8. The stringed musical instrument of claim 7, wherein the back access panel may be selected a balance of flexibility and rigidity to provide the degree of tension in the top to decrease undesirable feedback at high levels of electric amplification and the desired degree of alteration of the air mass within the instrument body to tune the harmonic overtones.

* * * * *